US011230846B2

(12) United States Patent
Hannig et al.

(10) Patent No.: US 11,230,846 B2
(45) **Date of Patent: *Jan. 25, 2022**

(54) PANEL

(71) Applicant: AKZENTA PANEELE + PROFILE GMBH, Kaisersesch (DE)

(72) Inventors: Hans-Jürgen Hannig, Bergisch Gladbach (DE); Arne Loebel, Düsseldorf (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/918,313

(22) Filed: Jul. 1, 2020

(65) Prior Publication Data

US 2020/0332532 A1 Oct. 22, 2020

Related U.S. Application Data

(63) Continuation of application No. 15/309,363, filed as application No. PCT/EP2015/060237 on May 8, 2015, now Pat. No. 10,711,466.

(30) Foreign Application Priority Data

May 8, 2014 (DE) ..... 10 2014 106 492.5

(51) Int. Cl.
*E04F 15/02* (2006.01)

(52) U.S. Cl.
CPC ..... *E04F 15/02038* (2013.01); *E04F 2201/0146* (2013.01)

(58) Field of Classification Search
CPC ..... E04F 15/02038
See application file for complete search history.

(56) References Cited

U.S. PATENT DOCUMENTS 6,233,896 B1 ‡ 5/2001 Coup ..... E04B 5/12 156/304.3
6,505,452 B1 ‡ 1/2003 Hannig ..... B27F 1/04 52/582.1
6,682,254 B1 ‡ 1/2004 Olofsson ..... E04B 1/6125 403/375

(Continued)

FOREIGN PATENT DOCUMENTS

DE 102005012827 B3 7/2006
DE 102005012827 B3 ‡ 7/2006 ..... E04F 15/02

(Continued)

OTHER PUBLICATIONS

Bestech "Modulus of Elasticity" https://www.bestech.com/au/wp-content/uploads/Modulus-of-Elasticity.pdf (Year: 2016).‡

(Continued)

*Primary Examiner* — Andrew J Triggs
(74) *Attorney, Agent, or Firm* — Stinson LLP

(57) ABSTRACT

A panel having at least one pair of complementary locking means at opposite panel edges, wherein at least one pair of the locking means is provided with complementary hook profile portions, wherein at least one of the hook profile portions has a compression region.

15 Claims, 9 Drawing Sheets

(56) References Cited

U.S. PATENT DOCUMENTS 6,862,857 B2 ‡ 3/2005 Tychsen ..... E04F 15/02 52/582.1
7,861,483 B2 ‡ 1/2011 Dammers ..... E04F 13/08 52/588.1
8,171,692 B2 ‡ 5/2012 Pervan ..... E04F 15/02 52/592.2
8,375,672 B2 * 2/2013 Hannig ..... E04F 15/02038 52/588.1
8,505,257 B2 ‡ 8/2013 Boo ..... B27F 1/02 52/582.1
8,584,432 B2 ‡ 11/2013 Braun ..... E04F 15/02 428/50
8,733,065 B2 ‡ 5/2014 Pervan ..... E04F 15/02 428/50
8,806,832 B2 ‡ 8/2014 Kell ..... E04F 15/02033 52/578
8,925,275 B2 ‡ 1/2015 Meersseman ..... B27N 7/00 52/313
8,991,055 B2 ‡ 3/2015 Cappelle ..... E04F 15/02 29/897.3
9,080,330 B2 ‡ 7/2015 Meersseman ..... B27N 7/00
9,103,126 B2 ‡ 8/2015 Kell ..... E04F 15/02033
9,409,326 B2 ‡ 8/2016 Schromm ..... B29C 43/228
9,540,825 B2 ‡ 1/2017 Ramachandra ..... E04F 15/105
10,711,466 B2 * 7/2020 Hannig ..... E04F 15/105
2003/0101681 A1 ‡ 6/2003 Tychsen ..... E04F 15/02 52/783.1
2005/0238865 A1 ‡ 10/2005 Konishi ..... B32B 37/0046 428/29
2006/0024465 A1 ‡ 2/2006 Briere ..... B32B 3/04 428/60
2007/0266666 A1 ‡ 11/2007 Dammers ..... E04F 13/08 52/536
2008/0060310 A1 ‡ 3/2008 Moriau ..... B27F 1/06 52/588.1
2009/0049787 A1 ‡ 2/2009 Hannig ..... E04F 15/02038 52/589.1
2009/0193748 A1 ‡ 8/2009 Boo ..... B27F 1/02 52/589.1
2010/0319293 A1 ‡ 12/2010 Dammers ..... E04F 13/08 52/588.1
2012/0066996 A1 ‡ 3/2012 Konstanczak ..... E04F 13/08 52/588.1
2012/0073235 A1 ‡ 3/2012 Hannig ..... B27M 3/0066 52/588.1
2012/0251784 A1 ‡ 10/2012 Verville ..... B27N 3/06 428/156
2013/0047536 A1 ‡ 2/2013 Pervan ..... B26D 1/14 52/309.1
2013/0081349 A1 ‡ 4/2013 Pervan ..... E04F 15/02038 52/588.1
2013/0309441 A1 * 11/2013 Hannig ..... F16B 5/0056 428/100
2014/0033636 A1 ‡ 2/2014 Cappelle ..... E04F 15/02 52/592.1
2014/0090335 A1 ‡ 4/2014 Pervan ..... B27F 1/08 52/745.05
2015/0064421 A1 ‡ 3/2015 Dohring ..... B44C 5/04 428/201
2016/0200092 A1 ‡ 7/2016 Doehring ..... B05D 7/586 52/588.1
2017/0067261 A1 * 3/2017 Han ..... E04F 15/105
2020/0332532 A1 * 10/2020 Hannig ..... E04F 15/02038

FOREIGN PATENT DOCUMENTS

DE 102005028072 A1 12/2006
DE 102005028072 B1 ‡ 12/2006
DE 102007053177 A1 ‡ 5/2009
DE 102007053177 A1 5/2009
DE 202008010555 U1 ‡ 12/2009 ..... E04F 15/02
DE 202008010555 U1 12/2009
DE 102008031167 A1 ‡ 1/2010 ..... E04F 15/02
DE 102008031167 A1 1/2010
DE 102010033578 A1 2/2012
DE 102010033578 A1 ‡ 2/2012
DE 102011086846 A1 ‡ 8/2012
DE 102011086846 A1 8/2012
DE 102010063976 B4 ‡ 1/2013 ..... E04F 15/10
DE 102010063976 B4 1/2013
DE 102011110071 A1 2/2013
DE 102011110071 A1 ‡ 2/2013 ..... E04F 15/02038
DE 102012013742 A1 ‡ 6/2013 ..... E04F 15/02038
DE 102012013742 A1 6/2013
EP 2333195 A1 6/2011
EP 2333195 A1 ‡ 6/2011
EP 2339092 A1 6/2011
EP 2339092 A1 ‡ 6/2011
WO 2008122668 A1 10/2008
WO 2011001326 A2 1/2011
WO WO-2011001326 A2 ‡ 1/2011 ..... E04F 15/02038
WO 2012126046 A1 9/2012
WO WO-2012126046 A1 ‡ 9/2012

OTHER PUBLICATIONS

"MDF/HDF Production for Plantation Wood Species" Alpan, Faczan, Racz, Katoli (Year: 2010).‡
Wood Nation "Bamboo—HDF Core vs. Plywood Core" https://woodwudy.com/pages/bamboo-hdf-core-vs-plywood-core (Year: 2019).‡
Arreis "SDF Sustainable Design Fiberboard" http://www.hardwoodweb.com/architectural/docs/SPECArreis.pdf (Year: 2008).‡

* cited by examiner
‡ imported from a related application

PANEL

REFERENCE TO RELATED APPLICATIONS

This is a continuation application of U.S. application Ser. No. 15/309,363 issued Jul. 14, 2020 as U.S. Pat. No. 10,711,466; which is a U.S. national stage application based on PCT/EP2015/060237 filed May 8, 2015 and claiming priority to German application DE 10 2014 106 492.5 filed May 8, 2014; the entire disclosures of which are expressly incorporated herein by reference.

FIELD OF THE INVENTION

The invention concerns a panel having at least one pair of complementary locking means at opposite panel edges, wherein at least one pair of the locking means is provided with complementary hook profile portions.

BACKGROUND

Such panels are used to produce for example floorings, in particular being suitable for floatingly laid floorings.

DE 20 2008 010555 discloses a panel of the general kind set forth. Its arresting step and receiving opening are of such a configuration that during a joining movement the end of the step initially fits to some degree into the receiving opening without elastic deformation of the hook profile portions and the hook profile portions are elastically deformed only in the further course of the joining movement.

It has been found that a floatingly laid flooring using the known panels can be difficult to lay. Both on a hard laying surface and also on a soft footstep-damping substrate there are sometimes problems in regard to locking so that irregularities can occur at the top side of the flooring in the region of the joins.

SUMMARY OF THE INVENTION

The object of the invention is to propose a panel whose complementary locking means can be better joined and locked both on a hard laying surface and also on a soft footstep-damping substrate. According to the invention that object is attained in that at least one of the hook profile portions has a compression region.

DETAILED DESCRIPTION OF PREFERRED EMBODIMENTS

Figure 1:
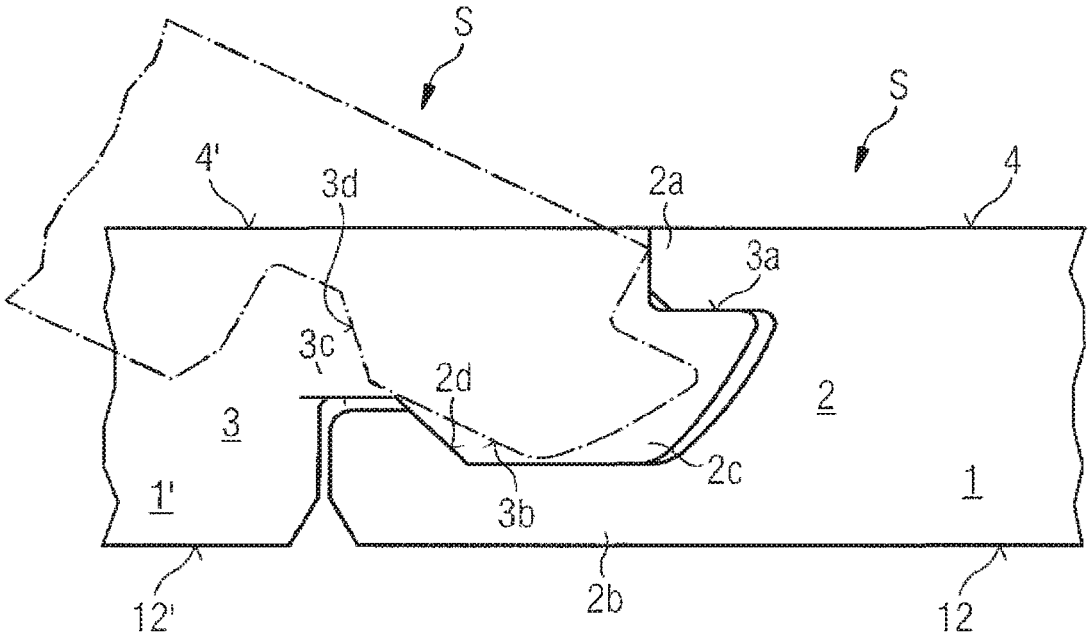
FIG. 1 shows an embodiment of a first pair of edges (longitudinal edges) with pivot profile portions.

The compression region of the hook profile portion has a favorable effect on the lockability of the hook profile portions. Insofar as a hook profile portion can be compressed in the compression region that simplifies arriving at the locked condition. Because compression involves elastic deformation the compressed condition is restored again after termination of the locking operation. The compression region then again assumes a neutral non-compressed configuration and deploys a locking action which acts in opposition to the locked panels moving away from each other in a direction perpendicular to the panel plane.

In an advantageous configuration the compression region is arranged at an outwardly directed surface of a panel edge.

In accordance with a further desirable configuration of the invention the panel has a top side, an underside, a body, complementary locking means which are provided pair-wise at mutually opposite panel edges, at least one pair of locking means with hook profile portions, namely a receiving hook and an arresting hook in opposite relationship thereto, with the proviso that the receiving hook has arranged remote from the body a hook edge and arranged closer to the body a receiving recess, wherein the receiving recess is open to the top side, that the arresting hook is provided with an arresting recess arranged closer to the body and open to the underside, and has an arresting step which is arranged remote from the body and which can be inserted into the receiving recess of the receiving hook in a joining direction provided perpendicularly to the plane of the panel, that the arresting hook has a transverse joining surface remote from the body and likewise remote from the body a vertically acting arresting contour, that the receiving hook closer to the body has a transverse joining surface and likewise closer to the body a positively locking contour which fits together in positively locking relationship with the arresting contour remote from the body of the arresting hook so that locking can be implemented perpendicularly to the plane of assembled panels, that the arresting hook has arranged closer to the body a horizontal locking surface at its arresting step, that the receiving hook has arranged remote from the body a horizontal locking surface in the receiving recess, that formed at the receiving hook is a receiving opening through which the arresting step can be inserted into the receiving recess substantially in the joining direction, wherein the arresting contour and the positively locking contour form an upper latching means in which the arresting contour has a female latching element or a male latching element, and wherein the positively locking contour has a female latching element or male latching element complementary to the arresting contour, wherein the male latching element and/or the female latching element of the arresting hook has an upper compression region with an arresting contour with increased compressibility, and that the male latching element and/or the female latching element of the receiving hook has an upper compression region with a receiving contour with increased compressibility.

When the arresting step is inserted into the receiving recess of the receiving hook that involves on the one hand contact between the arresting contour and the positively locking contour. In addition it entails contact between the horizontal locking surfaces of the arresting hook and the receiving hook. The horizontal locking surface of the arresting hook slides down along the horizontal locking surface of the receiving hook; they jointly form a support configuration. During the joining movement surface pressure occurs between the arresting contour and the positively locking contour, namely when the compressibly designed arresting contour comes into contact with the compressible receiving contour. Compression which then occurs in respect of those two regions makes it possible to produce a positively locking connection which provides for locking/latching perpendicularly to the plane of the panel.

The compressibility of the arresting contour and the receiving contour is such that a spot load occurring in those regions is produced, or a local limited surface pressure which also causes only locally limited compression in those regions. Compression occurs substantially in the material at the contact location at which the spot load/surface pressure is acting. Compressibility in other words is increased to such a degree that any other deformation of the hook profile portions that occurs at a location away from the above-mentioned contact location, is resisted. Thus for example bending of the hook profile portions is resisted.

To lay a flooring it has been found that panels can be more easily laid and locked on a soft surface if the hook profile portions are of such a configuration that deformation of the hook profile portions is resisted away from the above-mentioned contact location.

A desirable development provides that the hook edge of the receiving hook and the arresting recess of the arresting hook form a lower latching means in which remote from the body at the hook edge of the receiving hook there is provided a female latching element or a male latching element, and wherein close to the body the arresting recess has a female latching element complementary thereto or a male latching element.

The above-mentioned development can be further promoted in that the male latching element and/or the female latching element of the arresting hook has a lower arresting contour with increased compressibility and the male latching element and/or the female latching element of the receiving hook has a lower receiving contour with increased compressibility.

A further advantage is found therein if the body at least partially comprises a wood material or wood ingredients.

Alternatively the body can at least partially comprise a plastic.

In a configuration the body is produced in the form of a carrier plate comprising a plastic or a wood-plastic composite material (WPC). The carrier plate is formed for example from a thermoplastic, elastomer or thermosetting plastic. In addition recycled materials involving the specified materials can also be used in accordance with the invention. Preferably in that respect plate material is used, in particular comprising thermoplastic material such as polyvinyl chloride, polyolefins (for example polyethylene (PE), polypropylene (PP), polyamides (PA), polyurethane (PU), polystyrene (PS), acrylonitrile-butadiene-styrene (ABS), polymethylmethacrylate (PMMA), polycarbonate (PC), polyethyleneterephthalate (PET), polyetheretherketone (PEEK) or mixtures or co-polymers. In that case irrespective of the basic material of the carrier plate it is possible to provide for example plasticizers which can be present for example in a range of ≥0 wt. % to ≤20 wt. %, in particular ≤10 wt. %, preferably ≤7 wt. %, for example in a range of between ≥5 wt. % and ≤10 wt. %. A suitable plasticizer includes for example the plasticizer marketed by BASF under the trade name "Dinsch". In addition copolymers like for example acrylates or methacrylates can be provided as a substitute for conventional plasticizers.

In particular thermoplastic materials also offer the advantage that the products produced therefrom can be very easily recycled. Recycled materials from other sources can also be used. That affords a further possible way of reducing the manufacturing costs.

In that respect such carrier plates can be highly elastic or resilient, which allows a comfortable impression when walking and also can reduce the noise occurring when walking in comparison with conventional materials, and it is thus possible to provide for improved footstep damping.

In addition the above-mentioned carrier plate affords the advantage of good water resistance as it involves a swelling of 1% or less. That surprisingly also applies, besides pure plastic carriers, to WPC materials, as are described in detail hereinafter.

Particularly advantageously the carrier material can have or comprise wood-polymer materials (wood plastic composite or WPC). Here for example a wood and a polymer may be suitable, which can be present in a ratio of between 40/60 and 70/30, for example 50/50. As polymer constituents it is possible to use for example polypropylene, polyethylene or a copolymer of the two above-mentioned materials. Such materials afford the advantage that they can already be shaped at low temperatures like for example in a range of between ≥180° C. and ≤200° C. in the above-described method to constitute a carrier plate so that particularly effective process implementation, for example with line speeds by way of example in a region of 6 m/min, can be made possible. For example, for a WPC product with a 50/50 distribution of the wood and polymer components, they are possible with a product size by way of example of 4.1 mm, which can permit a particularly effective manufacturing process.

In particular highly stable panels can be produced in that way, which in addition enjoy high elasticity, which can be advantageous in particular for effective and inexpensive design configurations of connecting elements at the edge region of the carrier plate and in addition in regard to footstep damping. In addition the above-mentioned good water compatibility with a swelling effect of less than 1% can also be made possible with WPC materials of that kind. In that respect WPC materials can have for example stabilizers and/or other additives which can preferably be present in the plastic component.

Furthermore it can be particularly advantageous if the carrier plate includes or comprises a PVC-based material. Such materials can also serve in particularly advantageous fashion for high-quality panels which can also be used without any problem for example in wet rooms. In addition PVC-based materials for the carrier plate also present themselves for a particularly effective manufacturing process as here for example line speeds of 8 m/min can be possible with a product size for example of 4.1 mm, which can permit a particularly effective manufacturing process. In addition such carrier plates also have advantageous elasticity and water compatibility, which can result in the above-mentioned advantages.

In the case of plastic-based panels and also in the case of WPC-based panels mineral fillers can be of advantage in that case. Here for example talcum or also calcium carbonate (chalk), aluminum oxide, silica gel, quartz flour, wood powder and gypsum are particularly suitable here. For example chalk can be provided in a range of between ≥30 wt. % and ≤70 wt. %, wherein in particular slip of the carrier plate can be improved by the fillers, in particular by the chalk. They can also be colored in known fashion. In particular it can be provided that the material of the carrier plates has a flame resistant agent.

In a particularly preferred configuration of the invention the material of the carrier plate comprises a mixture of a PE/PP block copolymer with wood. In that case the proportion of the PE/PP block copolymer and the proportion of the wood can be between ≥45 wt. % and ≤55 wt. %. In addition the material of the carrier plate can have between ≥0 wt. % and ≤10 wt. % of further additives like for example flow aid agents, thermo stabilizers or UV-stabilizers. In that case the particle size of the wood is between ≥0 μm and ≤600 μm with a preferred particle size distribution D50 of ≥400 μm. In particular in that case the material of the carrier plate can have wood with a particle size distribution D10 of ≤400 μm. In that case the particle size distribution is related to the volumetric diameter and relates to the volume of the particles. Particularly preferably in that case the material of the carrier plate is provided in the form of granulated or pelleted pre-extruded mixture of a PE/PP block copolymer with wood particles of the specified particle size distribution. In that case the granular material and/or the pellets can preferably involve approximately a grain size in a range of between ≥400 μm and ≤10 mm, particularly preferably between ≥600 μm and ≤10 mm, in particular between ≥800 μm and ≤10 mm.

In a further preferred configuration of the invention the carrier plate comprises a mixture of a PE/PP polymer blend with wood. In that case the proportion of the PE/PP polymer blend and the proportion of the wood can be between ≥45 wt. % and ≤55 wt. %. In addition the material of the carrier plate can have between ≥0 wt. % and ≤10 wt. % of further additives like for example flow aid agents, thermostabilizers or UV-stabilizers. In that case the particle size of the wood is between >0 μm and ≤600 μm with a preferred particle size distribution D50 of ≥400 μm. In particular the carrier plate can have wood with a particle size distribution D10 of ≥400 μm. The particle size distribution is related to the volumetric diameter and relates to the volume of the particles. Particularly preferably in that case the material of the carrier is provided in the form of granulated or pelleted pre-extruded mixture of a PE/PP polymer blend with wood particles of the specified particle size distribution. In that case the granular material and/or the pellets can preferably involve approximately a grain size in a range of between ≥400 μm and ≤10 mm, particularly preferably between ≥600 μm and ≤10 mm, in particular between ≥800 μm and ≤10 mm.

In a further configuration of the invention the material of the carrier plate comprises a mixture of a PP homopolymer with wood. In that case the proportion of the PP homopolymer and the wood proportion can be between ≥45 wt. % and ≤55 wt. %. In addition the material of the carrier plate can have between ≥0 wt. % and ≤10 wt. % of further additives like for example flow aid agents, thermostabilizers or UV-stabilizers. In that case the particle size of the wood is between >0 μm and ≤600 μm with a preferred particle size distribution D50 of ≥400 μm. In particular in that case the carrier plate can have wood with a particle size distribution D10 of ≥400 μm. In that case the particle size distribution is related to the volumetric diameter and relates to the volume of the particles. Particularly preferably in that case the material of the carrier plate is provided in the form of granulated or pelleted pre-extruded mixture of a PP homopolymer with wood particles of the specified particle size distribution. The granular material and/or the pellets can in that case preferably be of a grain size in a range of between ≥400 μm and ≤10 mm, preferably between ≥600 μm and ≤10 mm, in particular between ≥800 μm and ≤10 mm. In a further configuration of the invention the material of the carrier plate comprises a mixture of a PVC polymer with chalk. In that case the proportion of the PVC polymer and the chalk proportion can be between ≥45 wt. % and ≤55 wt. %. In addition the material of the carrier plate can have between ≥0 wt. % and ≤10 wt. % of further additives like for example flow aid agents, thermostabilizers or UV-stabilizers. In that case the particle size of the chalk is between ≥0 μm and ≤600 μm with a preferred particle size distribution D50 of ≥400 μm. In particular in that case the material of the carrier plate can have chalk with a particle size distribution D10 of ≥400 μm. The particle size distribution in that case is related to the volumetric diameter and relates to the volume of the particles. In that case the material of the carrier plate is particularly preferably provided in the form of granulated or pelleted pre-extruded mixture of a PVC polymer with chalk of the specified particle size distribution. In that case the granular material and/or the pellets can preferably involve approximately a grain size in a range of between ≥400 μm and ≤10 mm, particularly preferably between ≥600 μm and ≤10 mm, in particular between ≥800 μm and ≤10 mm.

In a further configuration of the invention the material of the carrier plate comprises a mixture of a PVC polymer with wood. In that case the proportion of the PVC polymer and the wood proportion can be between ≥45 wt. % and ≤55 wt. %. In addition the material of the carrier plate can have between ≥0 wt. % and ≤10 wt. % of further additives like for example flow aid agents, thermostabilizers or UV-stabilizers. In that case the particle size of the wood is between >0 μm and ≤600 μm with a preferred particle size distribution D50 of ≥400 μm. In particular the material of the carrier plate can have wood with a particle size distribution D10 of ≥400 μm. In that case the particle size distribution is related to the volumetric diameter and relates to the volume of the particles. Particularly preferably in that case the material of the carrier plate is provided in the form of granulated or pelleted pre-extruded mixture of a PVC polymer with wood particles of the specified particle size distribution. In that case the granular material and/or the pellets can preferably involve approximately a grain size in a range of between ≥400 μm and ≤10 mm, particularly preferably between ≥600 μm and ≤10 mm, in particular between ≥800 μm and ≤10 mm.

For determining the particle size distribution it is possible to have recourse to the generally known methods like for example laser diffractometry, with which method it is possible to determine particle sizes in the range of between some nanometers up to several millimeters. It is thus also possible to ascertain D50 and D10 values which are 50% and 10% respectively of the measured particles smaller than the specified value.

In a further configuration of the invention the material of the carrier plate can have hollow microspheres. Such additives can provide in particular that the density of the carrier plate and thus the panel produced therefrom can be significantly reduced so that it is possible to ensure particularly simple and inexpensive transport and also particularly comfortable laying. In that case stability of the panel produced can be guaranteed in particular by the inclusion of hollow microspheres, the stability being insignificantly reduced in comparison with a material without hollow microspheres. Thus the stability for a major part of applications is totally adequate. In that respect the term hollow microspheres can denote in particular structures which have a hollow main body and are of a size or a maximum diameter which is in the micrometer range. For example hollow spheres which can be used can be of a diameter which is in the range of between ≥5 μm and ≤100 μm, for example ≥20 μm and ≤50 μm. In principle any material can be considered as the material of the hollow microspheres, like for example glass or ceramic. In addition, by virtue of the weight, plastic materials, for example the plastics which are also used in the carrier material, for example PVC, PE or PP, can be advantageous, in which case, for example by virtue of suitable additives, they can possibly be prevented from deformation during the manufacturing procedure.

The hardness of the material of the carrier plate can be of values in a range of 30-90 N/mm$^2$ (measured in accordance with Brinell). The modulus of elasticity can be in a range of between 3000 and 7000 N/mm$^2$.

In a further configuration of the invention the increased compressibility can be afforded by the choice of the material of the body which is of a hardness (Brinell hardness) in a range of 30-90 N/mm$^2$. In addition the material of the body can advantageously involve a modulus of elasticity in a range of between 3000 and 7000 N/mm$^2$ to achieve the increased compressibility.

In a preferred configuration of the invention it can be provided that the carrier plate is produced by means of a method having at least the following method steps:

a) providing a pourable carrier material, in particular a granulate, b) arranging the carrier material between two belt-like conveyor means, c) shaping the carrier material under the action of temperature with the production of a web-form carrier, d) compressing the carrier, and e) processing the carrier under the action of pressure using a two-belt press, wherein the carrier is cooled in or upstream of the two-belt press.

It was possible surprisingly to show that the above-described method can make it possible to combine particularly advantageous manufacture of in particular a carrier or a carrier plate for a wall or floor panel with materials which are particularly preferred for manufacture of the carrier of the panel by virtue of their outstanding properties. In that respect, a method of manufacturing in particular a carrier with outstanding materials of a decorated wall or floor panel can be made possible with improved effectiveness by a combination of the above-described method steps, which method in addition allows the production of extremely adaptable and very stable panels which at the same time have the material properties which are suitable for the locking means provided according to the invention, with a compression region. It is thus possible to easily produce panels which can have preferred properties.

In a further configuration of the above-described method further cooling of the carrier can be implemented prior to subsequent further processing, as method step f).

Firstly, in accordance with the present method, a carrier or a core is produced. For that purpose the above-described method includes in accordance with method step a) firstly the provision of a pourable carrier material. The carrier material serves as a basis for manufacture of in particular plate-shaped carriers for panels. It can be present for example in the form of a unitary material or can be in the form of a material mixture comprising two or more materials. In that respect the carrier material or at least a constituent of the carrier material should have a melting point or a softening temperature to shape the carrier material in a further method step by the action of heat, as is described in detail hereinafter. In a particularly advantageous fashion the carrier material can be provided as a pourable solid or in the form of a granular material, wherein, in dependence on the material used, purely by way of example, the granular material can be for example of a grain size in a range of between ≥100 μm and ≤10 mm. That allows storability without any problem and also affords particularly good adaptability to a desired material composition. For, particularly in granular form, it is possible to produce a particularly homogeneous mixture of various constituents, in which case it is possible to produce a particularly defined mixture with an accurately adjustable composition. By way of example it is possible to use so-called dry blends, that is to say dry plastic powder with additives. In addition a granular material, in particular in the above-described size range, can be distributed highly homogeneously and also in very defined fashion on a substrate surface so that it is possible to produce a carrier with a very well defined property profile. Preferred pouring or distribution of the carrier material can in that case involve a deviation in respect of the bulk density of ≤5%, in particular ≤3%.

In accordance with method step b) the pourable, in particular granular, carrier material is arranged between two belt-like conveyor means. In detail a lower belt-like conveyor means is displaced with a circulatory movement and an upper belt-like conveyor means is displaced in a circulatory movement at a defined spacing relative to the lower conveyor means. The carrier material can thus be applied to the lower conveyor means and then limited by the lower and the upper conveyor means. In that case it is possible to dispense with lateral limiting means by virtue of precise scattering of the carrier material. The carrier material can thus be conveyed to or through individual processing stations by the two conveyor means, and processed to constitute a carrier. In addition the carrier material can already be pre-formed in that method step. Thus the belt-like conveyor means can perform two functions, namely that of a transport means and that of a shaping means.

In that case the belt-like conveyor means, at least in the region of the two-belt press, as is described hereinafter, is at least partially made from Teflon or from polytetrafluorethylene (PTFE). For example the belts can be formed completely from polytetrafluorethylene or it is possible to use belts which are provided with an outer coating of polytetrafluorethylene. In the latter case for example it is possible to use glass fiber-reinforced plastic belts or also steel belts. By virtue of the anti-adhesion properties of that material such conveyor means can provide that a particularly well-defined, for example smooth surface can be produced on the carrier manufactured. It is thus possible to prevent the conveyed carrier material from adhering to the conveyor means and thus adversely influencing the surface structure directly or by adhering material in a following cycle. In addition polytetrafluorethylene is resistant to chemicals and also to decomposition even at high temperatures so that on the one hand temperature treatment of the carrier material is possible without any problem and in addition the conveyor means can also be stable for a long period of time. Furthermore the carrier material can be freely selected.

In that arrangement the conveyor means can pass through the entire apparatus or they can be interrupted and can be in the form of a plurality of conveyor means.

Discharge of the carrier material in accordance with method step b) can be implemented in particular by means of one or a plurality of scatter heads which can discharge the carrier material in defined fashion. In regard to the scatter heads they may be for example a component part of a scatter assembly and can have at least one rotating scatter roller. For example it is possible to provide a hopper which can discharge the material to be discharged on to the scatter roller in a defined fashion. A doctor can further be provided, which spreads the material in recesses in the roller. The material can then be discharged from the scatter roller by means of a rotating brush roller, in which case it impinges against a baffle plate and slides from there on to the conveyor means. A scatter width adjustment can also be provided to regulate the scatter width. In this configuration particularly homogeneous discharge of the carrier material can be effected, which can equally result in a homogeneous carrier of defined quality.

For example it is possible to provide one scatter head or two, three or more scatter heads. In that way the carrier can be in particular wet-cuttable in a particularly simple fashion, insofar as for example a desired material mixture can be produced. In this configuration the mixture can be adapted without any problem during the manufacturing process or between two batches so as to be able to ensure a particularly high level of variability. In addition a mixture for the carrier material can be produced only directly prior to the processing operation, by virtue of the individual scatter heads being differently equipped, so that it is possible to avoid adverse influencing of the various components with each other and a resulting reduction in the quality of the carrier produced.

In a further step, in accordance with method step c), shaping of the carrier material disposed between the belt-like conveyor means is effected under the action of temperature or heat. In this method step the heat or temperature acting on the material thus causes the carrier material or at least a part thereof to melt or soften, whereby for example the granular material can become shapable. In that condition it can homogeneously fill the receiving space which is formed between the conveyor means, and thus constitute a web-like carrier which can be further processed.

The resulting web-like carrier can be compressed at the same time as or after method step c) in accordance with method step d). That method step can be effected in particular in a suitable press or roller. It is here therefore that first compacting of the web-like carrier occurs. In this step the carrier can already acquire substantially its desired thickness so that in subsequent processing steps only slight compacting needs to be effected and the further steps can thus take place in a particularly careful and gentle fashion, as is described in detail hereinafter. In that case it is possible in particular to ensure that the temperature of the carrier is cooled down to such an extent that suitable compressibility can be made possible, achieving the desired result.

In a further method step e) further treatment of the carrier now takes place, under the effect of pressure using a two-belt press. In this method step in particular the surface properties of the carrier can be adjusted. For example smoothing of the surface can be effected in this method step. For that purpose the previously compacted carrier can be treated under the action of pressure, in which case in particular the pressure can be selected to be low in such a way that this second compression operation takes place only in a very small range. For example compression can be effected in a range of ≤10%, ≤5%, in particular ≤3%, of the total thickness of the carrier prior to the compressing operation. For example compacting can be effected in a range of 0.2-0.3 mm, with a plate thickness of 4.5 mm. Thus the configuration of the processing apparatus in this method step can be in particular selected in dependence on a desired adjustment in respect of the surface properties, which can be particularly gentle. Thus the two-belt press can serve as a calibration zone, in particular for adjusting the definitive surface properties like also the thickness of the carrier.

In that respect in particular the use of a two-belt press can be advantageous as particularly gentle and careful compressing steps are possible with such a press and in addition the surface quality can be particularly effectively adjusted in a defined fashion. Furthermore in particular the use of a belt press can permit high line speeds so that the entire procedure can permit a particularly high throughput rate.

For example such a belt press which generally has a quite long processing chamber in the direction in which the carrier is conveyed can have a plurality of temperature control zones, which can allow a temperature profile and thus effective adjustment of the surface properties, even when high line speeds are involved.

In addition for example by virtue of the provision of pneumatic cylinders it is possible to provide for particularly uniform and definedly adjustable belt tension in the two-belt press so that adjustment of the surface quality and also compression can be particularly exact. The belt press can have for example steel belts, for example without a coating or coated for example with polytetrafluorethylene, and/or can be temperature-controlled for example by thermal oil heating.

Smoothing or adjustment of the surface quality can signify in this step that admittedly the uppermost surface is smoothed, structures or pores which for example have already been formed are however not influenced or are influenced only in a defined range, so that even after this method step they can still be present in the desired fashion, insofar as that is wanted. That can be made possible in particular by the use of a belt press with a suitable temperature profile and with suitable pressure values.

In that respect it is further provided that the carrier is cooled prior to or in the two-belt press and thus in particular during or prior to method step e), in particular below the melting point or the softening point of a plastic constituent of the carrier material. In that case cooling can be effected only in a limited range so that the carrier admittedly still involves a temperature which is increased in comparison with room temperature (22° C.), but is below the previously set increased temperature and in that respect preferably and depending on the plastic used, below the melting point or the softening point of the plastic contained in the carrier material. That can be effected for example by a suitable choice of the temperature of the temperature control devices which are disposed in the two-belt press or the carrier can be cooled or less heated in particular by temperature-control means arranged before the two-belt press. Particularly by cooling of the carrier it is possible to produce a surface configuration which in particular is of a high grade in terms of quality as the belts of the two-belt press which can be made for example from polytetrafluorethylene (Teflon) are spared stress in that case. In addition dishing or the occurrence of shrinkage cavities or pores can be prevented so that the surface of the carrier can be particularly high-quality. Suitable temperatures are for example and non-limitingly in a range of below 130° C., for example in a range of between ≥80° C. and ≤115° C., for example 120° C., for polyethylene.

In the further procedure a further method step f) then possibly involves further cooling of the web-like carrier. The carrier can be cooled in particular by the provision of a cooling device having defined cooling stages to a temperature which corresponds to room temperature or which purely by way of example is in a region of up to 20° C. thereabove. For example there can be a plurality of cooling zones to permit defined cooling of the carrier.

After cooling of the carrier produced the carrier can firstly be stored in web-like form or as separate plate-like carriers and the method can next be concluded. Preferably however further treatment steps directly follow, which can be performed for example without grinding, in particular so as to process the produced carrier in such a way as to manufacture a finished panel, as is described in detail hereinafter.

A further advantage is afforded if a material recess or recesses in respect of the lower and/or upper arresting contour and the lower and/or upper receiving contour are provided, wherein the material recess or recesses locally increase compressibility insofar as the force acting at the moment of locking on the receiving contour acts on a smaller surface area. The increased surface pressure produces a greater travel distance for compression. Besides the choice of a suitable material for the carrier plate there is therefore also a constructional possible way of influencing the compressibility at the desired locations. Thus for example it is possible to provide material recesses of a tooth gap-like configuration.

The underside of the receiving hook is preferably disposed in a plane identical to the plane of the underside of the panel.

Each female latching element desirably has a latching surface directed towards the top side or the underside of the panel, and each male latching element has a complementary latching surface directed towards the respective other side of the panel so that the latching surface of the female latching element together with the latching surface of the male latching element in the locked condition of two panels opposes movement of locked panels away from each other perpendicularly to the panel plane.

Preferably the latching surface of the female latching element is in contact with the latching surface of the male latching element in the locked condition of two panels. In that way the lower latching means contributes to firm locking perpendicularly to the plane of assembled panels.

Alternatively there can be a gap between the latching surface of the female latching element and the latching surface of the associated male element in the locked condition of two panels. That can simplify the assembly procedure if for example a relative displacement is to be implemented between the transverse edges. A gap of a few tenths of a millimeter appears to be sufficient, preferably about 0.1 mm.

The panels can be so designed that during the joining movement firstly the upper latching means and then the lower latching means are completely brought together.

The horizontal locking surfaces of the hook profile portions are preferably inclined with respect to the surface normal of the top side by an angle of between 0° and 25° and are arranged substantially parallel to each other in the locked condition of two panels. The angle of inclination substantially depends on the configuration of the arresting contour and the positively locking contour, in particular on where the female or male latching element respectively is arranged. An angle of inclination of between 7° and 25° has been found to be desirable. The trend is that it is possible to provide a smaller angle of inclination if the arresting contour is provided with the female latching element and the positively locking contour has the male latching element fitting thereto. The smaller the angle of inclination, the correspondingly higher is the holding force to prevent separation in the plane of the assembled panels and perpendicularly to the transverse edges in question. Therefore angles of inclination of <7° are preferred and an angle of inclination of about 3° is particularly desirable. In principle a negative angle of inclination of the two horizontal locking surfaces is also possible. In that way that would produce a locking action perpendicularly to the panel plane. In the event of interchange of the female and the male latching element a larger angle of inclination is generally desirable so that the arresting contour and the positively locking contour can be connected together.

The hook edge of the receiving hook can have remote from the body an inclined sliding portion. This involves a surface which is inclined with respect to the panel plane and which simplifies insertion of the hook edge into the arresting recess in the arresting hook.

In a preferred configuration the arresting step on its side remote from the body has an inclined sliding portion.

The inclined sliding portion is a surface which is inclined with respect to the panel plane and which simplifies insertion of the arresting step in the receiving recess in the receiving hook. It is desirably of such a configuration that it comes into contact with the positively locking contour. At the same time the horizontal locking surface of the arresting hook slides down along the horizontal locking surface of the receiving hook and forms a support means. In that way a surface pressure is produced during the joining movement by virtue of the contact between the inclined sliding portion and the positively locking contour. In particular this involves compression of the arresting contour and the receiving contour. The compression of those regions makes it possible to produce a positively locking connection. The inclined sliding portion facilitates locking of the two panels.

The compressible regions of the receiving contour and the arresting contour are elastically compressed. In the further joining movement the arresting contour passes the positively locking contour until both have reached a position in which they fit into each other in positively locking relationship. In that way it is possible to produce a closed join. The horizontal locking surfaces of the two hook profiles are preferably then caused to bear snugly against each other.

In order to be able to easily connect the panels there can be provided a pair of pivot profile portions, namely a groove profile portion with an undercut in a groove wall and in matching relationship therewith a tongue profile portion with undercut on the corresponding side of the tongue. That has the advantage that panels can be desirably assembled in such a way that a fresh panel with a pivot profile portion is fitted to the complementary pivot profile portion of a panel which has already been fitted, and is pivoted into the plane thereof. In addition and also advantageously in that case the hook profile portion of the fresh panel can be locked at the same time to the hook profile portion of a panel in the same row of panels. At the same time the pivotal movement provides that the arresting hook of the fresh panel is also moved downwardly in a scissor-like movement substantially in a vertical plane and is inserted into the receiving hook of a panel disposed in the same row of panels. During the scissor-like movement the arresting step firstly projects only at one end of the panel edge into the receiving opening. When the scissor-like joining movement continues the arresting step moves step by step into the receiving opening. When the panels are finally in one plane the arresting contour and the positively locking contour are exactly fitted into each other; the transverse joining surfaces are in contact and form a closed join.

A transparent cover layer and/or a decorative layer can be provided at the top side, with the body or the decorative layer being visible through the transparent cover layer. The transparent cover layer serves to protect the layer beneath it. It can be provided with means which alleviate wear, for example corundum particles, glass particles and so forth and/or can itself comprise chemically hardening resistant material, for example a lacquer which is hardened by ultraviolet light or a hardenable resin layer like for example a melamine-bearing resin layer.

A counterpart layer can be provided at the underside of the panel. That acts as a balance in relation to the layers on the top side to counteract warping of the panel.

In addition there is proposed a possible way and thus a method with which a fresh rectangular panel provided with two longitudinal edges and two transverse edges can be locked at the same time to a previous row of panels already assembled from identical panels and to an identical panel, which has already been fitted, in the same row of panels, more specifically with the proviso that a first longitudinal edge is connected to the previous row of panels in positively locking relationship by pivoting the fresh panel into the plane of the assembled panels, wherein at the same time a first transverse edge of the fresh panel is brought into positively locking engagement by a scissor-like movement with a second transverse edge of the fitted panel in the same row of panels, with the further proviso that the first transverse edge of the panels respectively has a first transverse joining surface and the second transverse edge of the panels respectively has a second transverse joining surface, wherein the first transverse joining surface is brought into contact at that end which is towards the first longitudinal edge with the second transverse joining surface of the fitted panel in the same row of panels, wherein the positively locking connection between the longitudinal edge and the transverse edge of the fresh panel is produced by a longitudinal join gap and a transverse join gap being produced between the fresh panel and the previous row of panels, the wedge tip of the transverse joining gap points in the direction of the previous row of panels and the wedge tip of the longitudinal join gap points in the direction of the free second transverse edge of the fresh panel, and the fresh panel is finally pivoted into the plane of the assembled panels, wherein the positively locking engagement of the transverse edges and the longitudinal edges are completely assembled and the wedge-shaped joining gaps are nullified. Due to the transverse joining gap the transverse edges are a little displaced/shifted in their longitudinal direction. The displacement corresponds to the gap dimension at the widest point of the transverse joining gap. To remove the displacement the transverse edges must be moveable/displaceable relative to each other. It is then desirable if at least one latching means, for example the lower latching means, is of such a configuration that there is a small gap, for example 0.1 mm, between latching surfaces, in order to facilitate mobility of the transverse edges.

The longitudinal joining gap can be produced by the fresh panel being moved temporarily out of its parallel orientation with respect to the previous row of panels and by the wedge tip of the longitudinal joining gap being produced at the remote end of the first longitudinal edge of the fresh panel.

The longitudinal joining gap on the other hand can be produced by the fresh panel being temporarily moved out of its flat form, by being curved up out of its panel plane in the direction of its top side.

The invention is illustrated by way of example hereinafter in a drawing and described in detail by reference to a number of embodiments by way of example.

FIG. 1 shows a first pair of edges of a panel 1 and 1' respectively according to the invention. This Figure shows a pair of longitudinal edges of a rectangular panel. The pair of longitudinal edges has complementary pivot profile portions S. All positively locking profile portions known in the state of the art can be provided as such, which can be positively lockingly connected together by inclinedly fitting a fresh panel to a previous row of panels and then pivoting a fresh panel 1' into the plane of the assembled panels.

The complementary pivot profile portions S shown in FIG. 1 include a groove profile portion 2 and a tongue profile portion 3. The groove profile portion 2 has an upper groove wall 2*a* shorter than the lower groove wall 2*b*. The lower groove wall is further provided with a recess 2*c* of an undercut configuration for the tongue profile portion 3. The recess 2*c* also has a horizontal locking surface 2*d*. The tongue profile portion 3 is provided with a tongue top side 3*a* and a tongue underside 3*b* which is arranged substantially parallel to the top side 4' of the fresh panel 1'. The tongue underside has an undercut portion 3*c* and a horizontal locking surface 3*d* which cooperates with the horizontal locking surface 2*d* of the lower groove wall 2*b*. The inclined positioning of the fresh panel 1' is clearly indicated in FIG. 1 by the broken-line position of the tongue profile portion 3'. The tongue underside is placed on the longer lower groove wall 2*b*. The fresh panel 1' is moved with the tongue tip leading into the groove profile portion 2 and the fresh panel 1' is then pivoted into the plane of the fitted panel or the assembled panels. The undersides 12 and 12' of the panels 1 and 1' are then in one plane.

Figure 2A:
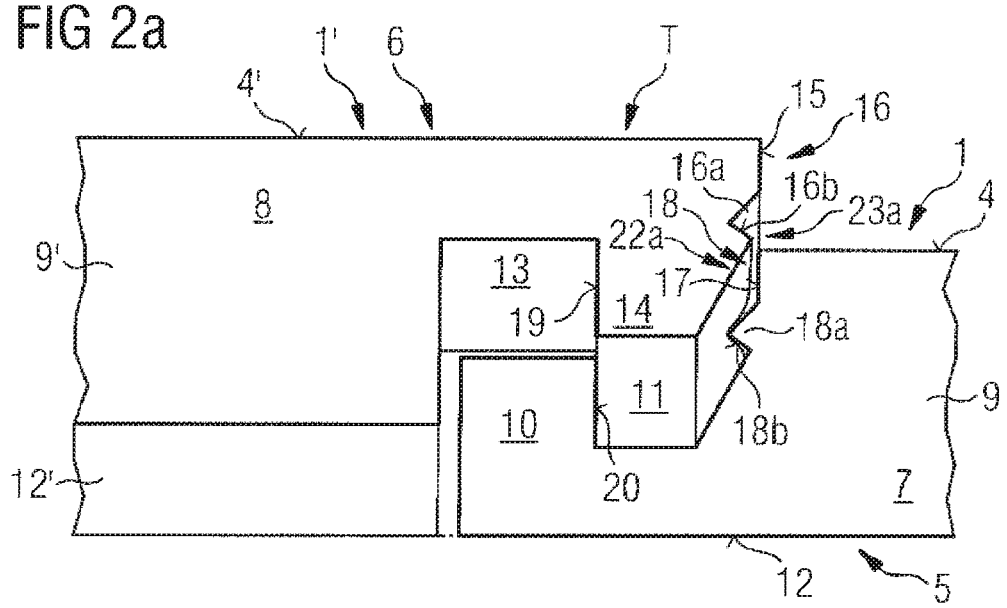
FIGS. 2*a*-2*c* show complementary locking means of a second pair of edges (transverse edges) and the stepwise joining movement thereof.
Figure 2B:
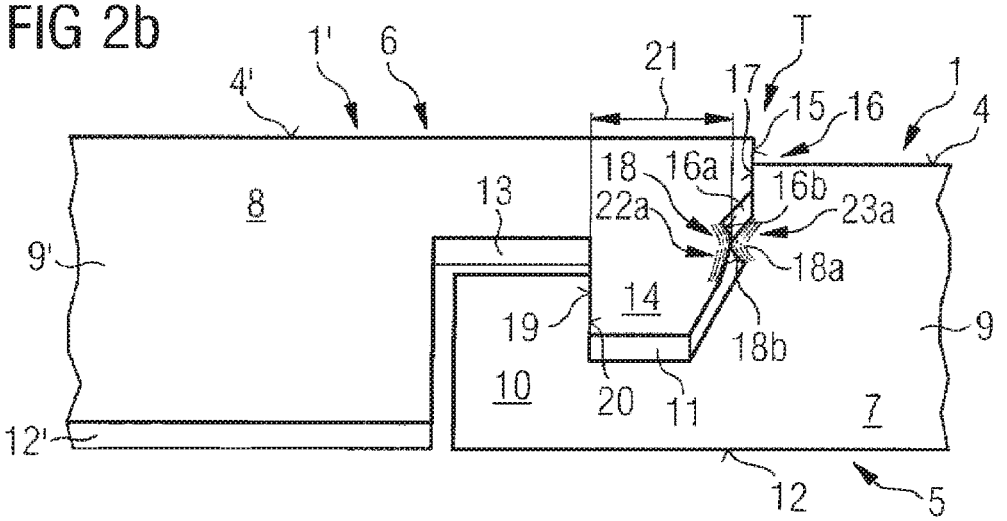
Figure 2C:
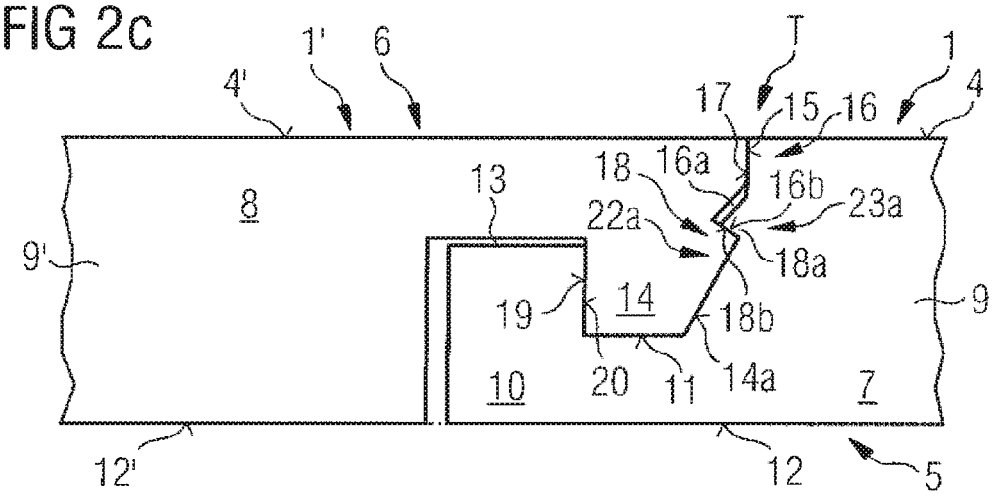

A second pair of edges of another type is shown as respective portions thereof in FIGS. 2*a* through 2*c*. This pair of edges is provided at the transverse edges of the panel 1 and 1' respectively. The panels 1 and 1' are identical panels. Each individual panel has complementary profiles 5 and 6 respectively at opposite transverse edges of a pair of edges. In the case of the panel 1 therefore the edge which is not shown has a profile portion identical to the profile portion 5 of the panel 1' while in the case of the panel 1' the edge which is not shown is identical with the profile 6 of the panel 1.

For the sake of completeness it is noted that embodiments with rectangular panels are also possible, whose first pair of edges (pair of longitudinal edges) are formed with complementary profile portions which are identical to the profile portions of the second pair of edges (pair of transverse edges).

The series in FIGS. 2*a* through 2*c* show in a plurality of steps the implementation in principle of the joining movement for the purposes of connecting and locking/latching the panels 1 and 1'.

The complementary profile portions 5 and 6 of each panel 1 and 1' form complementary locking means in the form of hook profile portions H. The hook profile portion of the panel 1 forms a receiving hook 7 and the hook profile portion of the profile portion 1' forms an arresting hook 8 which fits into the receiving hook. In this case the two hook profile portions are so designed that arresting or upper latching is effected, which opposes movement of the panels away from each other in the reverse direction. The panels 1 and 1' can thus not be separated from each other again, after locking/latching has occurred, perpendicularly to the plane of the assembled panels.

Each panel 1 and 1' includes a body 9 and 9' respectively, at which the above-mentioned complementary locking means are arranged. The top side 4 of the panels respectively forms a working surface. The body which can also be referred to as the carrier plate in the present embodiment has a wood-plastic composite material (WPC). Alternatively the carrier plate can comprise a plastic, for example a thermoplastic, elastomer or thermosetting plastic or a recycled material consisting of the specified materials.

Provided on the receiving hook 7 remote from the body is a hook edge 10 and closer to the body is a receiving recess 11. The receiving recess 11 is open to the top side 4.

The arresting hook 8 is provided with an arresting recess 13 which is arranged closer to the body and which is open to the underside 12, and has remote from the body an arresting step 14. The arresting step fits in a perpendicular joining direction T into the receiving recess 11 of the receiving hook 7. The arresting hook 8 further has a transverse joining surface 15 remote from the body and also remote from the body an arresting contour 16 which has a vertically locking action. The receiving hook 15 has close to the body a transverse joining surface 17 and likewise close to the body a positively locking contour 18 which fits together with the arresting contour 16 of the arresting hook 8 in positively locking relationship. In that way an upper latching means $V_O$ is formed, with which locking can be implemented, perpendicularly to the panel plane.

In addition the arresting hook 8 has, arranged close to the body, a horizontal locking surface 19 arranged at its arresting step 14. In fitting relationship therewith the receiving hook 7 has, arranged remote from the body in the receiving recess 11, a horizontal locking surface 20 cooperating with the horizontal locking surface 19 of the arresting hook 8.

The receiving hook 7 is provided at its receiving recess 11 with a constricted receiving opening 21. The arresting step 14 can be inserted substantially in a perpendicular joining direction T into the receiving recess 11, in other words, in a plane perpendicular to the plane of the locked panels.

Referring to FIGS. 2*a* through 2*c* the panel is arranged with the receiving hook 7 on a firm substrate (not shown). The arresting step 14 of the panel 1' is moved downwardly for the purposes of locking the panel edges perpendicular to the panel plane (that is to say vertically). The arresting contour 16, that is remote from the body, of the arresting hook 7 has an upper arresting contour 23*a* which is compressible and is provided with a female latching element 16*a* (recess shape). The female latching element 16*a* has a latching surface 16*b* which is directed towards the top side 4' of the panel 1' and which is set back behind the plane of the transverse joining surface 15 of the arresting hook 6. The positively locking contour 18 which is close to the body of the receiving hook 7 has an upper receiving contour 22*a* which is compressible and is provided with a male latching element 18*a*. The male latching element 18*a* has a latching surface 18*b* which is directed towards the underside 12 of the panel 1 and projects beyond the plane of the transverse joining surface 17 of the receiving hook 7. In the locked condition the latching surface 18*b* engages behind the female latching element 16*a* of the arresting hook 8.

The upper receiving contour 22*a* embraces the male latching element 18*a*. In addition the compressible upper arresting contour 23*a* embraces the female latching element 16*a* of the arresting hook 8. The upper arresting contour 23*a* thus substantially embraces that material region which forms the latching surface 16*b*. At an end of the latching surface 16*b* the female latching element forms a free tip. Under a load acting in point form from the exterior on the free tip it yields; it is elastically compressed and flattened off. That occurs when the compressible male latching element 18*a* is brought into point contact with the free tip of the female latching element 16*a*. In that situation the male latching element 18*a* is in turn flattened out.

The compressibility afforded in that way in respect of the male latching element 18*a* and the female latching element is essentially based on the material property of the material forming the body. In the present example it is of a hardness (Brinell hardness) of 40 $N/mm^2$ and a modulus of elasticity of 4000 $N/mm^2$.

By virtue of that compressibility the arresting contour 16 of the arresting hook 8 can be particularly easily fitted into the positively locking contour 18 of the receiving hook 7.

In addition FIG. 2*b* shows that the receiving hook 7 at its hook edge 10 has an outside surface which in the assembled condition of two panels does not involve any contact with an oppositely disposed surface, close to the body, of the arresting hook 8.

Figure 3A:
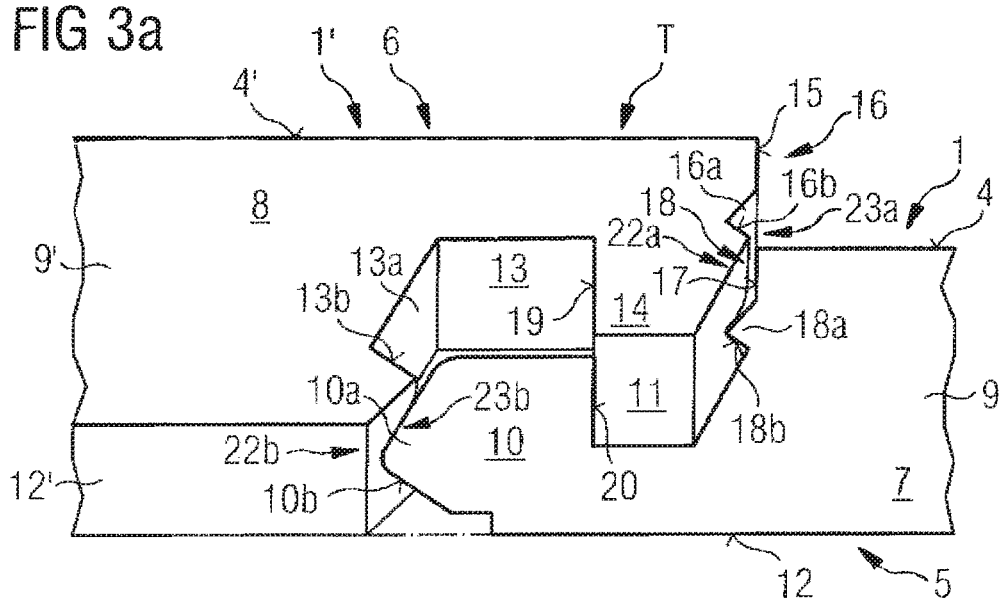
FIGS. 3*a*-3*c* show a first alternative embodiment of complementary locking means of a second pair of edges (transverse edges) and the stepwise joining movement thereof.
Figure 3B:
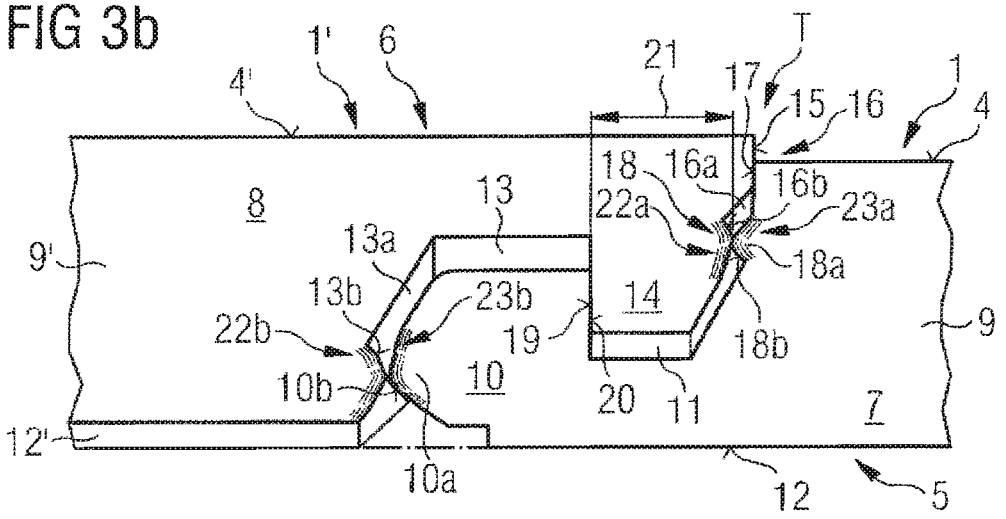
Figure 3C:
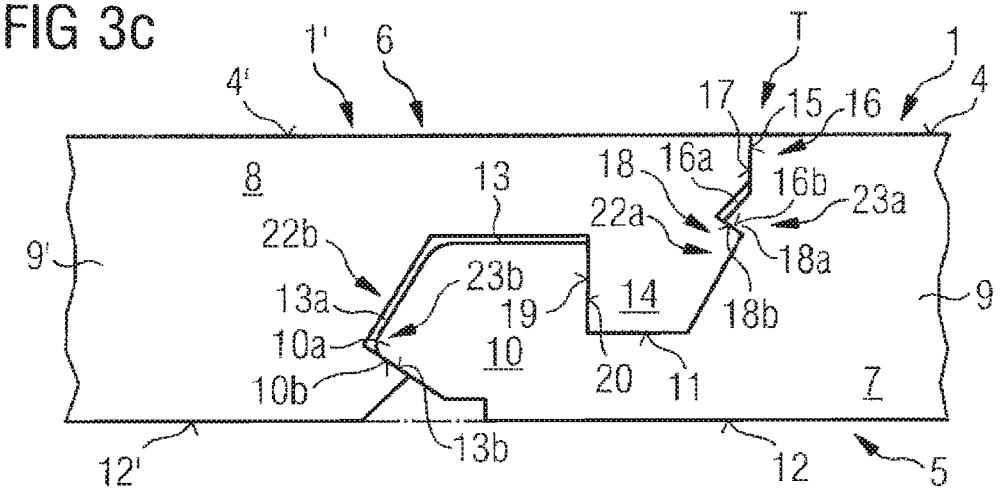

FIGS. 3*a*-3*c* show a development of the above-described embodiment in which there is provided an additional lower latching means $V_U$ which improves the locking action perpendicularly to the plane of the panels. Identical references are used in all the following Figures for identical design features.

Referring to FIG. 3*a* the arresting hook 8—for making a lower latching means $V_U$—is provided with a female latching element 13*a*. It has a latching surface 13*b* directed towards the top side 4' of the panel 1'. In fitting relationship therewith the receiving hook 7 is provided with a male latching element 10*a*. That has a latching surface 10*b* directed towards the underside 12 of the panel 1 so that it can cooperate with the latching surface 13*b* of the female latching element 13*a*.

The arresting hook 8 is so designed that the arresting recess 13 of the arresting hook 8 is expanded in the joining operation and at the same time the hook edge 10 is upset. For that purpose, provided on the arresting hook 8 is a compressible lower arresting contour 23*b* while provided on the receiving hook is a compressible lower receiving contour 22*b*. The lower arresting contour 23*b* is substantially that material region that forms the female latching element 13*a* having the latching surface 13*b*. It has a free tip which is provided remote from the body at the latching surface 13*b* and which can be well elastically flattened out when it comes into point contact with the male latching element 10*a* of the lower receiving contour 22*b*. In contact with each other, both sides flatten out, namely the male latching element 10*a* and also the female latching element at the free tip of the latching surface 13*b*.

Figure 4A:
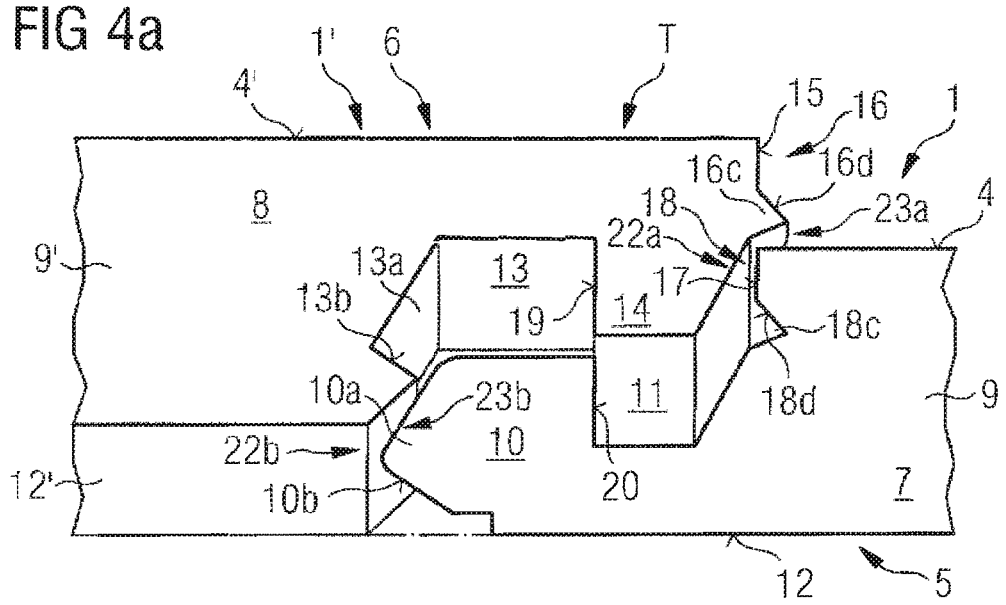
FIGS. 4*a*-4*c* show a second alternative embodiment of complementary locking means of a second pair of edges (transverse edges) and the stepwise joining movement thereof.
Figure 4B:
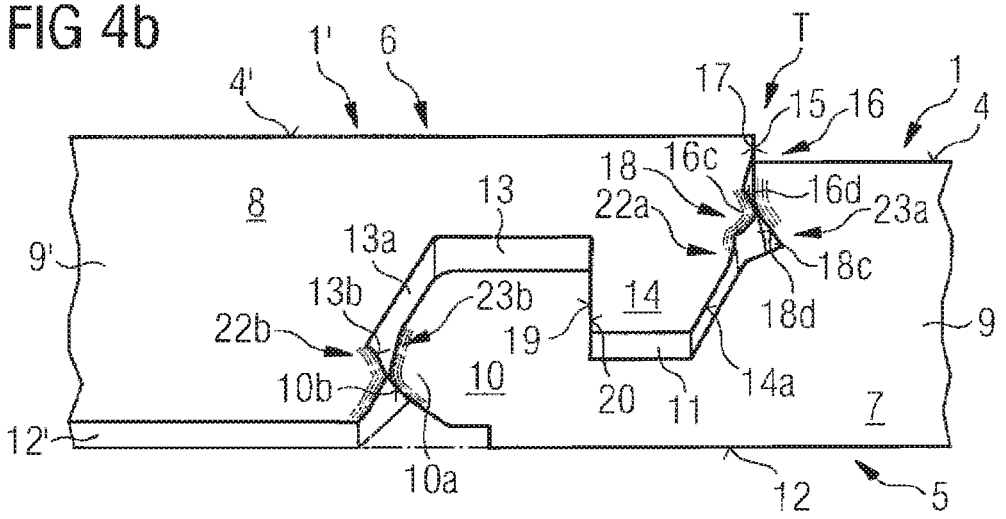
Figure 4C:
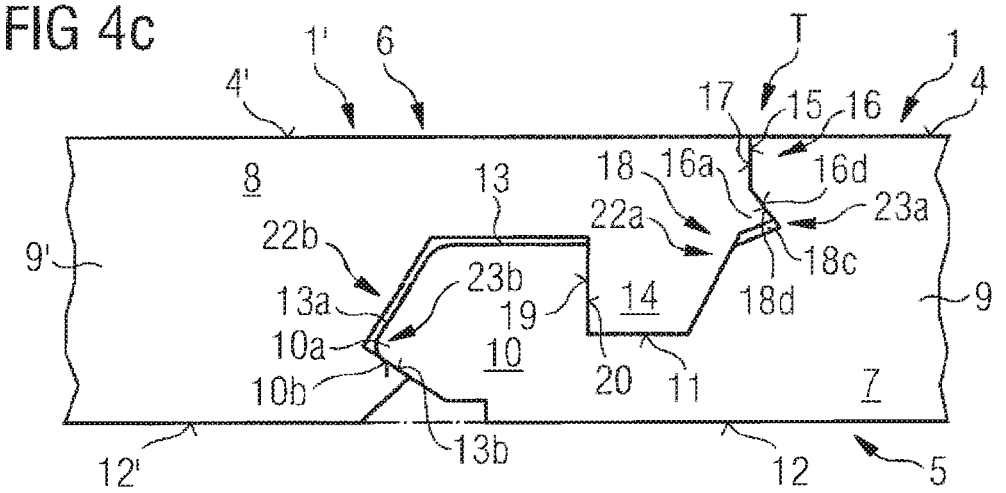

FIGS. 4*a*-4*c* show an alternative to the previous Figures. In this alternative the female and male latching elements are interchanged, in other words the upper latching means $V_O$ has been modified in such a way that the arresting hook 8 has a compressible upper arresting contour 23*a* whose latching element 16*c* is male and an upwardly facing latching surface 16*b*. In matching relationship therewith the positively locking contour of the receiving hook 7 has a compressible upper receiving contour 22*a* with a female latching element 18*c* and a downwardly facing latching surface 18*d*. In the locked condition the latching surfaces 16*d*/18*d* are in contact with each other and prevent detachment of the connected panels in a direction perpendicular to the plane of the panels. The lower latching means $V_U$ is in contrast identical to that lower latching means which was proposed in FIGS. 3*a*-3*c*.

Figure 5A:
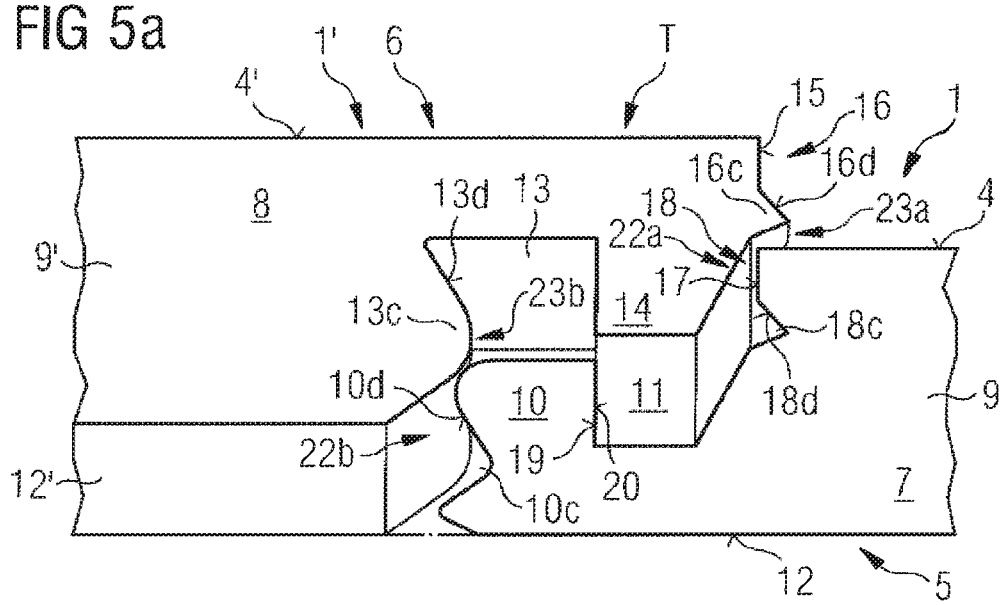
FIGS. 5*a*-5*c* show a third alternative embodiment of complementary locking means of a second pair of edges (transverse edges) and the stepwise joining movement thereof.
Figure 5B:
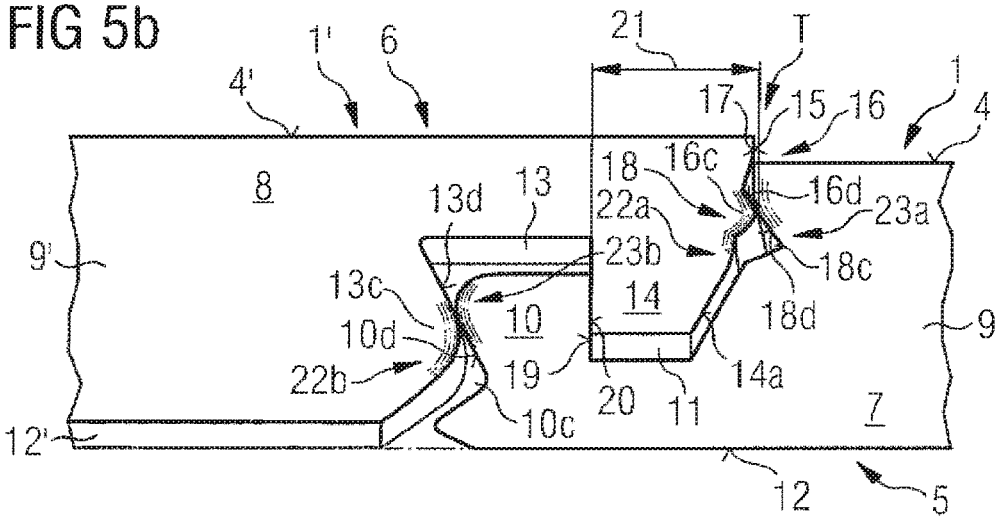
Figure 5C:
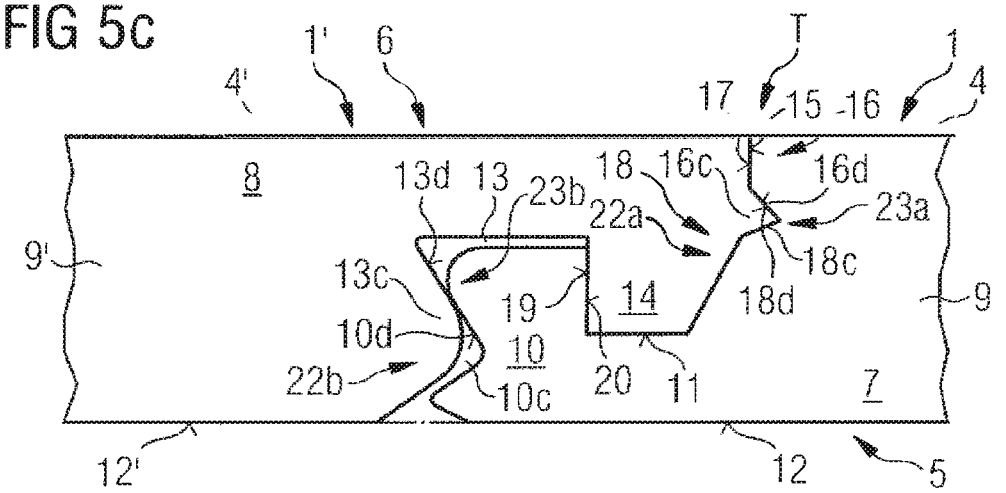

A further alternative is shown in FIGS. 5*a*-5*c*. This again differs from the previous Figures by interchange of the male and female latching elements of the lower latching means $V_U$. Here the compressible lower arresting contour 23*b* of the arresting hook 8 has a male latching element 13*c* while the compressible lower receiving contour 22*b* of the receiving hook 7 is provided with a female latching element 10*c* which includes a latching surface 10*d*. The compressibility of the lower arresting contour 22*b* is substantially based on that material region which forms the latching surface 10*d*.

A free tip is pronounced at an end of the latching surface 10*d* of the female latching element. Under a load acting in point relationship from the exterior on the free tip it yields; it is elastically compressed and flattened out. That occurs when the compressible male latching element 13*c* comes into point contact with the free tip of the female latching element 10*c*. In that case the male latching element 13*c* in turn yields and is flattened out.

Figure 6A:
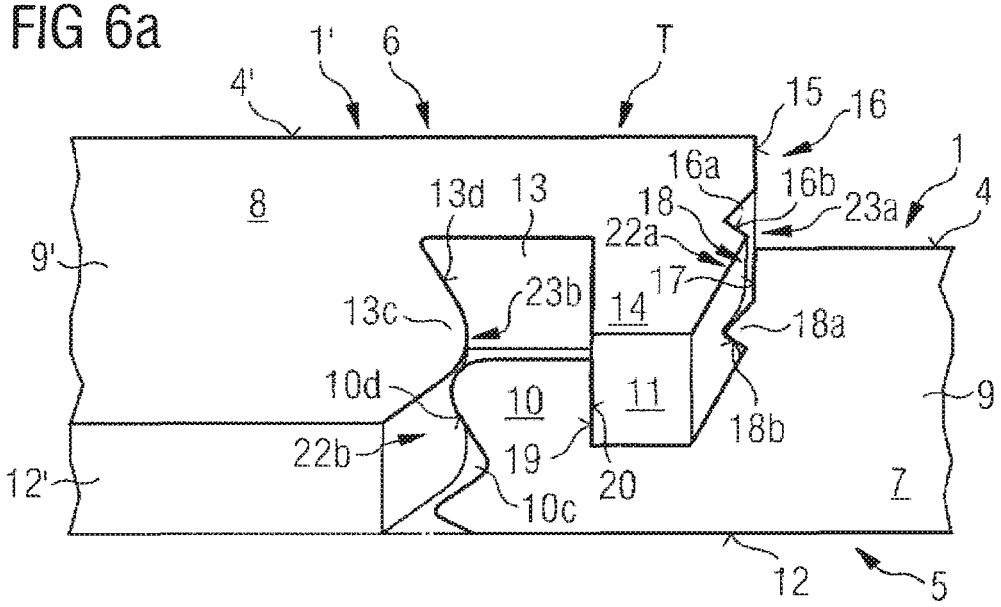
FIGS. 6*a*-6*c* show a fourth alternative embodiment of complementary locking means of a second pair of edges (transverse edges) and the stepwise joining movement thereof.
Figure 6B:
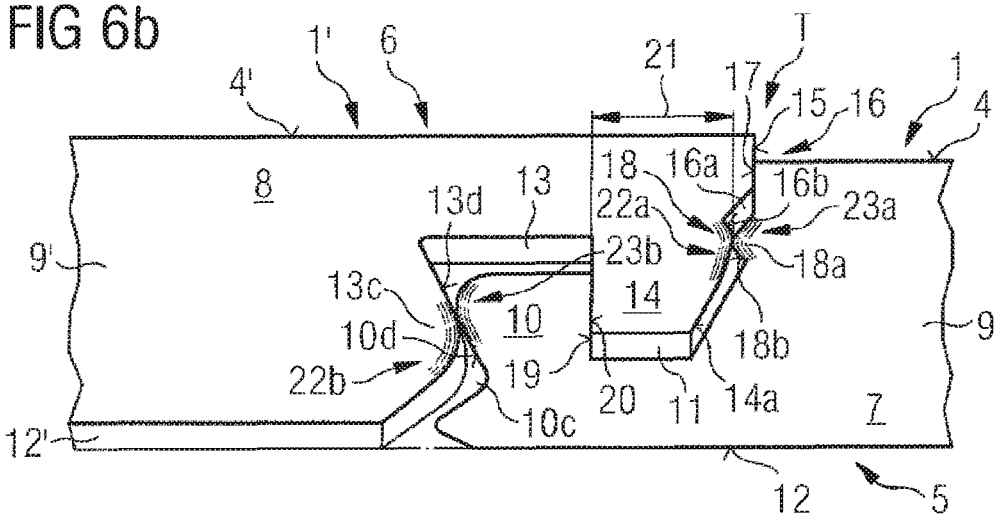
Figure 6C:
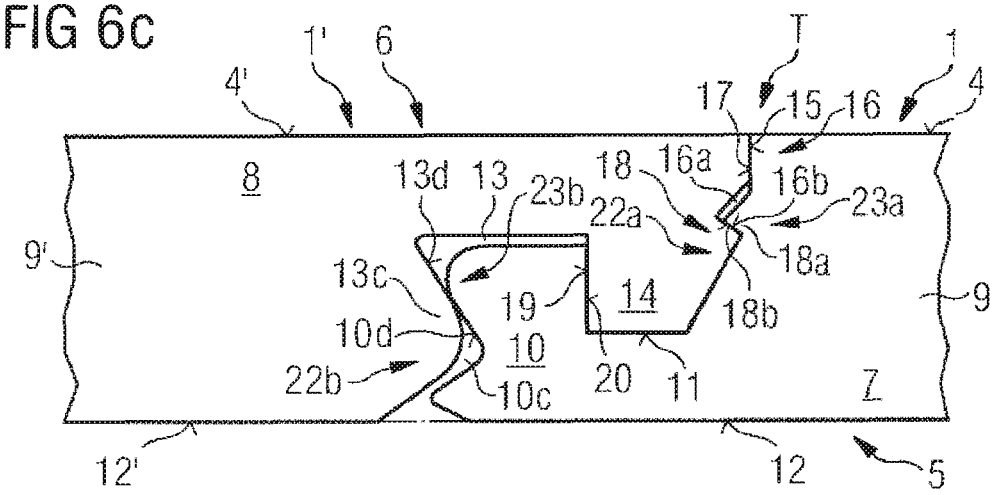

A last alternative is shown in FIGS. 6*a*-6*c*. Here the upper latching means corresponds to that of the embodiment of FIGS. 2*a*-2*c*/3*a*-3*c* while the lower latching means $V_U$ is identical to the lower latching means which were described with reference to FIGS. 5*a*-5*c*.

Figure 7:
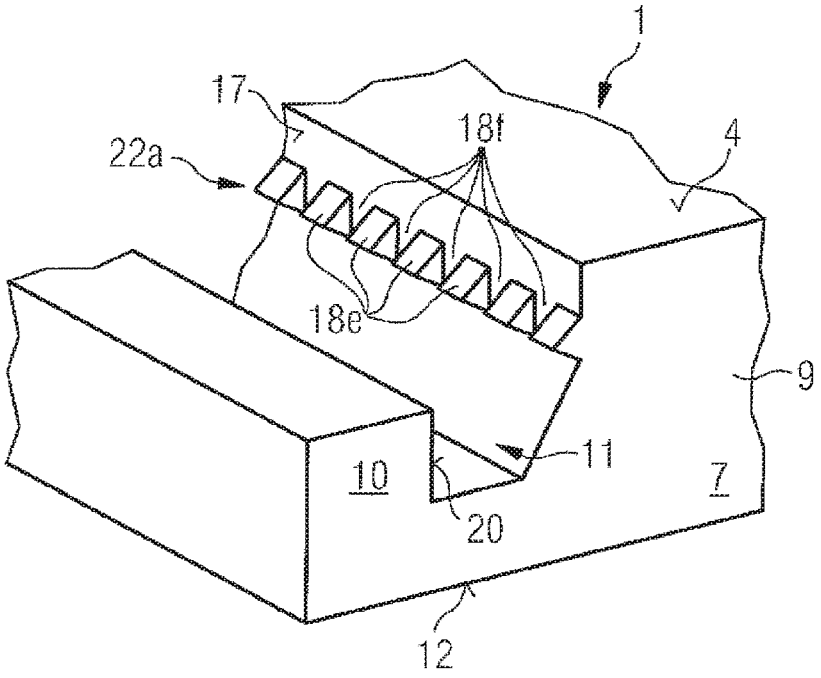
FIG. 7 shows a portion of a panel with locking means of a compressible configuration.

Finally FIG. 7 shows an example of a development of the panel as shown in FIGS. 2*a*-2*c*. Of that panel, FIG. 7 shows a portion of the panel edge with the receiving hook 7. The hook edge 10 remote from the body has a flat outside surface. There is provided a compressible upper receiving contour 22*a* having a male latching element 18*e*. The particularity of this embodiment is that the male latching element 18*e* is provided with material recesses 18*f*. The male latching element 18*e* involves the basic shape of a rib of approximately triangular cross-section. In this arrangement the material recesses 18*f* are implemented in the form of groove-shaped gaps. The gaps alternate with the remaining rib portions of the male latching element 18*e*. That provides a "comb-like" configuration for the male latching element. That configuration increases the compressibility of the male latching element. The rib portions can expand into the gaps when they are compressed.

In the present example the groove walls of the material recesses 18*f* are arranged parallel to each other and perpendicular to the plane of the panel.

It will be appreciated that the material recesses 18*f* can be of any other configuration which increases the compressibility of the male latching element 18*e*.

A variant which is not shown provides that the groove walls of the material recesses are arranged in planes which are respectively inclined at an acute angle relative to the plane of the panel.

Another variant provides that the material recesses are to be so arranged that they form cavities in the interior of the compressible material region. They can be of such a design configuration that they are not visible from the exterior.

Figure 9:
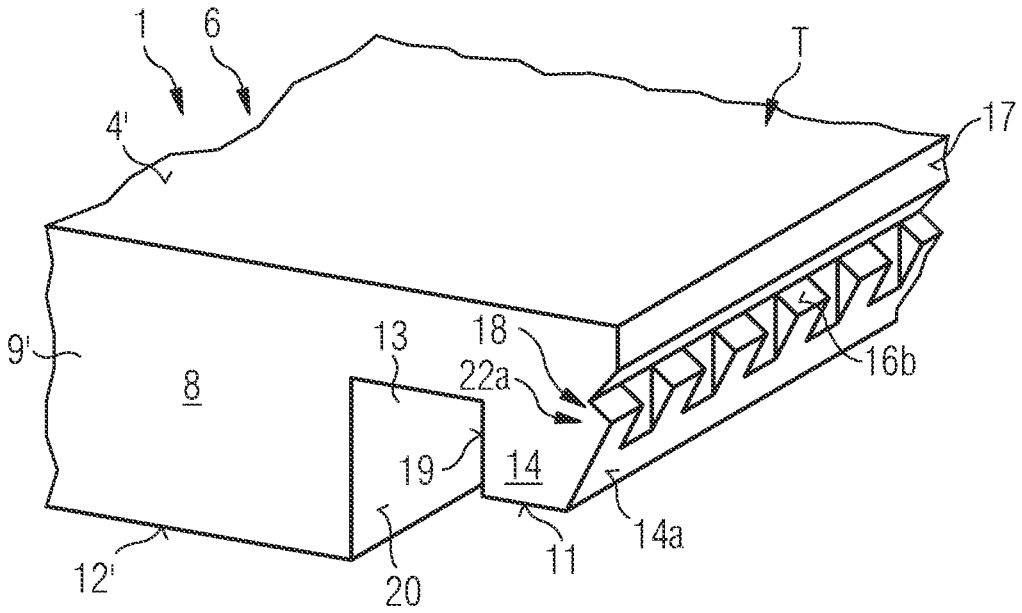
FIG. 9 shows an embodiment with material recesses which increase compressibility in the region of the arresting contour (female element).

In the case of the female latching elements 10*c*, 13*a*, 16*a* and 18*c* of the above-described embodiments it is also possible for those material regions which have to be compressed for a locking action to be provided with additional material recesses which also increase the compressibility in the region of the respective female latching element. See FIG. 9. The reference numerals in FIG. 9 correspond to the elements shown and described above in connection with FIGS. 2*a* through 2*c*, such as the latching surface 16*b* of the female latching element on the arresting step 14.

Figure 8A:
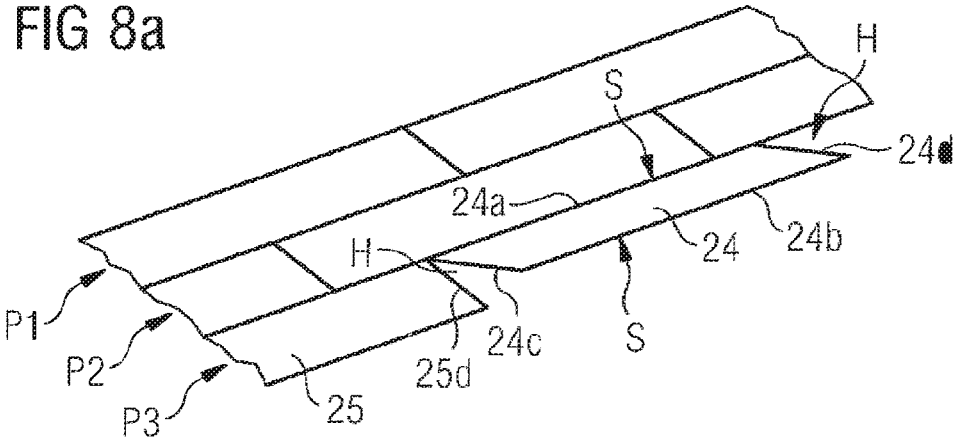
FIGS. 8*a*-8*c* show diagrammatic views of the laying of a flooring with panels according to the invention.
Figure 8B:
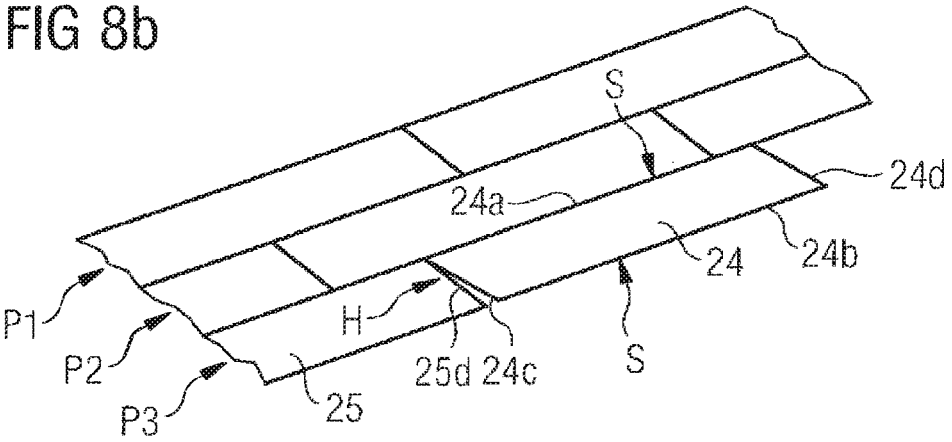
Figure 8C:
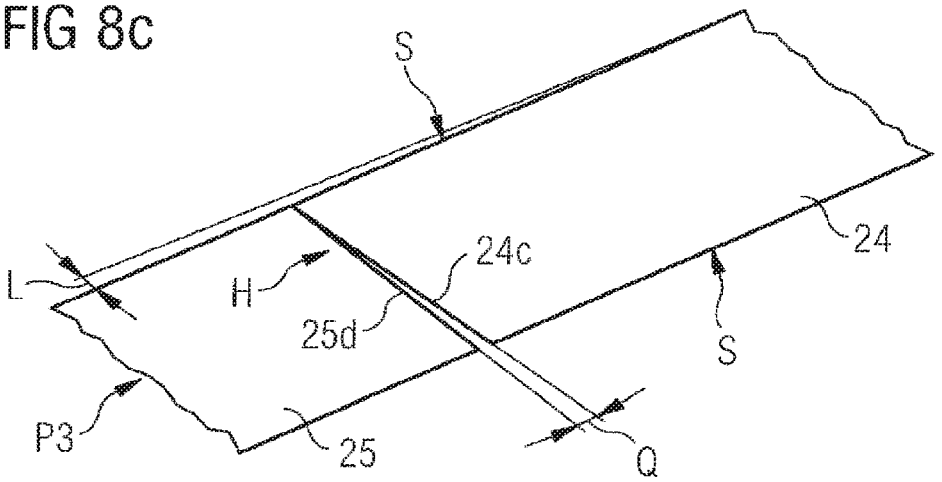

For fitting a fresh panel 24 provided with two longitudinal edges and two transverse edges, in accordance with FIGS. 8*a*-8*c* it is proposed how that panel can be locked to a previous row of panels P2 already assembled from identical panels, and at the same time to an identical panel 25 which has already been fitted in the same row of panels P3.

FIGS. 8*a*-8*c* show the production of a flooring comprising panels according to the invention. The Figures show portions of the rows of panels P1-P3. The fresh rectangular panel 24 is only diagrammatically shown. The panels being used involve an embodiment having a pair of longitudinal edges 24*a*/24*b* which is provided with complementary positively locking pivot profile portions S and a pair of transverse edges 24*c*/24*d* which have complementary hook profile portions H. The pivot profile portions S serve to interconnect panels of different rows of panels. In this embodiment the hook profile portions H serve to connect together panels of the same row of panels P3. The hook profile portions H of the pair of transverse edges can be of such a configuration as is shown in one of the embodiments of FIGS. 2*a* through 6*c*.

FIG. 8 shows how a fresh panel 24 is fitted in the foremost row of panels P3, which panel 24 is to be locked both to the previous row of panels P2 and also to a transverse edge 25*b* of an adjacent panel 25 in the same row P3. The fresh panel 24 is fitted to the front panel row P2 inclinedly in relation to the plane of the assembled panels and with one of its pivot profile portions S. Then, it is locked to the previous row P2 by pivotal movement into the plane of the assembled panels. At the same time the hook profile portion (arresting hook 8) of the fresh panel 24, that is provided on the transverse edge 24*c*, is also locked to the hook profile portion (receiving hook 7) of the panel 25 in the same row P3, that is provided at the transverse edge 25*d*. While the fresh panel 24 is being pivoted into the plane of the assembled panels the arresting hook 8 is at the same time brought into engagement with the receiving hook 7 in a scissor-like joining movement.

The positively locking connection of the longitudinal edge 24*a* and the transverse edge 24*c* of the fresh panel 24 is implemented as shown in FIG. 8*c*, insofar as a longitudinal joining gap L is produced between the fresh panel 24 and the previous row P2 and a transverse joining gap Q is implemented between the transverse edge 25*d* of the panel 25 and the transverse edge 24*c* of the fresh panel 24. The wedge tip of the transverse joining gap Q points in the direction of the previous row P2 of panels and the wedge tip of the longitudinal joining gap L points in the direction of the free second transverse edge 24*d* of the fresh panel 24. When finally the fresh panel 24 is pivoted into the plane of the assembled panels the positively locking engagement of the transverse edges 24*c*/25*d* and the longitudinal edge 24*a* with the previous row P2 of panels is implemented in its completely assembled condition and the wedge-shaped joining gaps Q and L are eliminated.

The longitudinal joining gap L is produced by the fresh panel 24 being temporarily moved out of its parallel orientation with the previous row P2 of panels and the wedge tip of the longitudinal joining gap L is produced at the remote end of the first longitudinal edge 24*a* of the fresh panel 24.

LIST OF REFERENCES

1 panel
1' panel
2 groove profile portion
2*a* upper groove wall
2*b* lower groove wall

2*c* recess
2*d* horizontal locking surface
3 tongue profile
3*a* tongue top side
3*b* tongue underside
3*c* undercut configuration
3*d* horizontal locking surface
4 top side
4' top side
5 profile portion
6 profile portion
7 receiving hook
8 arresting hook
9 body
9' body
10 hook edge
10*a* male latching element
10*b* latching surface
10*c* female latching element
10*d* latching surface
11 receiving recess
12 underside
12' underside
13 arresting recess
13*a* female latching element
13*b* latching surface
13*c* male latching element
13*d* latching surface
14 arresting step
14*a* inclined sliding portion
15 transverse joining surface (arresting hook)
16 arresting contour
16*a* female latching element
16*b* latching surface
16*c* male latching element
16*d* latching surface
17 transverse joining surface (receiving hook)
18 positively locking contour
18*a* male latching element
18*b* latching surface
18*c* female latching element
18*d* latching surface
19 horizontal locking surface (arresting hook)
20 horizontal locking surface (receiving hook)
21 receiving opening
22*a* upper receiving contour
22*b* lower receiving contour
23*a* upper arresting contour
23*b* lower arresting contour
24 fresh panel
24*a* longitudinal edge
24*b* longitudinal edge
24*c* transverse edge
24*d* transverse edge
25 panel
25*d* transverse edge
H hook profile portion
L longitudinal joining gap
Q transverse joining gap
S pivot profile portion
T joining direction
$V_O$ upper latching means
$V_U$ lower latching means

The invention claimed is:

1. Two panels, each having a body, opposite panel edges, and at least one pair of complementary locking structures at opposite panel edges, wherein the at least one pair of the locking structures comprises a receiving hook and an arresting hook, wherein the arresting hook of one panel fits into the receiving hook of the other panel;

wherein the arresting hook has an arresting contour and the receiving hook has a positively locking contour;

wherein the arresting contour and the positively locking contour are compressible and consist of a material having a Brinell hardness in a range of 30-90 N/mm$^2$ and a modulus of elasticity in a range between 3000 and 7000 N/mm$^2$ so the arresting contour and positively locking contour have increased compressibility involving elastic deformation to produce a positive locking connection between the arresting contour and positively locking contour upon insertion of the arresting contour into the positively locking contour;

wherein there is a gap between a latching surface of a female latching element and a latching surface of a male latching element in a locked condition of the two panels, said gap is about a few tenths of a millimeter or about 0.1 mm.

2. The panels according to claim 1, wherein the arresting contour and positively locking contour are arranged at an outwardly directed surface of one of the panel edges.

3. The panels according to claim 1, each comprising a top side and an underside, wherein the positively locking contour of each receiving hook has remote from the body a hook edge and arranged closer to the body a receiving recess, wherein the receiving recess is open to the top side, wherein each arresting contour of each arresting hook has an arresting recess arranged closer to the body and open to the underside, and has an arresting step arranged remote from the body and insertable into the receiving recess of the receiving hook of the other panel in a joining direction perpendicular to a plane of the panels, wherein the arresting contour of each arresting hook is vertically acting, and each arresting hook has a transverse joining surface remote from the body, wherein the receiving hook has a transverse joining surface closer to the body than the transverse joining surface of the arresting hook and the positively locking contour which fits together in positively locking relationship with the arresting contour remote from the body is closer to the body so that locking can be implemented perpendicularly to a plane of assembled panels, and the arresting hook has closer to the body a horizontal locking surface at its arresting step, wherein the receiving hook has remote from the body a horizontal locking surface in the receiving recess, wherein a receiving opening is formed at the receiving hook, the arresting step being insertable through the receiving opening into the receiving recess substantially in the joining direction, wherein the arresting contour and the positively locking contour form an upper latching means in which the arresting contour of the arresting hook has a female latching element or a male latching element, and the positively locking contour of the receiving hook has a female latching element or male latching element complementary to the arresting contour, wherein the male latching element and female latching element of the arresting hook and of the receiving hook comprise said material having Brinell hardness in the range of 30-90 N/mm$^2$ and modulus of elasticity in the range between 3000 and 7000 N/mm$^2$.

4. The panels according to claim 3, wherein the hook edge of the receiving hook and the arresting recess of the arresting hook form a lower latching means in which remote from the body at the hook edge of the receiving hook there is provided a female latching element or a male latching element, and wherein close to the body the arresting recess has a female latching element complementary thereto or a male latching element.

5. The panels according to claim 3, further comprising a lower latching means comprising a lower female or male latching element on a lower arresting contour of the arresting hook and a lower female or male latching element on a lower positively locking contour of the receiving hook complementary to the female latching element or male latching element on the lower arresting contour of the arresting hook.

6. The panels according to claim 3, wherein the body at least partially comprises a wood material.

7. The panels according to claim 3, wherein the body at least partially comprises a plastic.

8. The panels according to claim 1, wherein at least one material recess is provided in the arresting contour and the at least one material recess locally imparts compressibility.

9. The panels according to claim 1, wherein the locking structures consist of a groove profile portion with an undercut in a groove wall and in matching relationship therewith a tongue profile portion with undercut on the corresponding side of the tongue.

10. The panels according to claim 1, wherein each panel has a carrier plate produced by means of a method which has at least the following method steps:

a) providing a pourable carrier material, in particular a granulate, b) arranging the carrier material between two belt-like conveyor means, c) shaping the carrier material under the action of temperature with the production of a web-form carrier, d) compressing the carrier, and e) processing the carrier under the action of pressure using a two-belt press, wherein the carrier is cooled in or upstream of the two-belt press.

11. The panels according to claim 10, wherein the carrier plate is produced by means of a method which has at least one additional method step f) in which further cooling of the carrier is effected prior to subsequent further processing operation.

12. The panels according to claim 1, wherein the ribs of the positively locking contour have a triangular cross-section.

13. Two panels, each having a body, opposite panel edges, and at least one pair of complementary locking structures at opposite panel edges, wherein the at least one pair of the locking structures comprises a receiving hook and an arresting hook, wherein the arresting hook of one panel fits into the receiving hook of the other panel;

wherein the arresting hook has an arresting contour and the receiving hook has a positively locking contour;

wherein the arresting contour and the positively locking contour are compressible and consist of a material having a Brinell hardness in a range of 40-90 $N/mm^2$ and a modulus of elasticity in a range between 3000 and 7000 $N/mm^2$ so the arresting contour and positively locking contour have compressibility involving elastic deformation to produce a positive locking connection between the arresting contour and positively locking contour upon insertion of the arresting contour into the positively locking contour;

wherein the arresting contour comprises a comb-like configuration of ribs and groove-shaped gaps.

14. The panels according to claim 13, wherein the ribs of the arresting contour have a triangular cross-section.

15. Two panels, each having a body, opposite panel edges, and at least one pair of complementary locking structures at opposite panel edges, wherein the at least one pair of the locking structures comprises a receiving hook and an arresting hook, wherein the arresting hook of one panel fits into the receiving hook of the other panel;

wherein the arresting hook has an arresting contour and the receiving hook has a positively locking contour;

wherein the arresting contour and the positively locking contour are compressible and consist of a material having a Brinell hardness in a range of 30-90 $N/mm^2$ and a modulus of elasticity in a range between 4000 and 7000 $N/mm^2$ so the arresting contour and positively locking contour have compressibility involving elastic deformation to produce a positive locking connection between the arresting contour and positively locking contour upon insertion of the arresting contour into the positively locking contour;

wherein the arresting contour comprises a comb-like configuration of ribs and groove-shaped gaps.

* * * * *